US005297872A

United States Patent [19]

Caligiuri

[11] Patent Number: 5,297,872

[45] Date of Patent: Mar. 29, 1994

[54] SHOPPING BAG AND POUCH THEREFOR

[76] Inventor: Theodore L. Caligiuri, 436 Ardmore Ave., Hermosa Beach, Calif. 90254

[21] Appl. No.: 27,014

[22] Filed: Mar. 5, 1993

Related U.S. Application Data

[63] Continuation-in-part of Ser. No. 845,231, Mar. 3, 1992, abandoned.

[51] Int. Cl.[5] ..... B65D 30/10

[52] U.S. Cl. ..... 383/86; 383/4; 383/40; 383/87; 383/907

[58] Field of Search ..... 383/4, 8, 37, 38, 40, 383/80, 84, 86, 87, 907; 150/111, 112, 117, 118, 119, 150, 152; 206/315.9, 315.91; 273/60 R

[56] References Cited

U.S. PATENT DOCUMENTS

| | | | |
|---|---|---|---|
| 1,479,137 | 1/1924 | Guinzberg | 383/907 X |
| 2,493,085 | 1/1950 | Pincus | 383/4 X |
| 4,810,102 | 3/1989 | Norton | 383/4 |
| 5,004,144 | 4/1991 | Selga | 383/4 X |
| 5,009,516 | 4/1991 | Goeck | 383/37 |
| 5,085,320 | 2/1992 | Scott | 206/315.9 |
| 5,152,612 | 10/1992 | Shoemaker | 383/4 X |

*Primary Examiner*—Allan M. Shoap
*Assistant Examiner*—Jes F. Pascua
*Attorney, Agent, or Firm*—J. E. Brunton

[57] ABSTRACT

A shopping bag and carrying pouch therefor in which the pouch is of unique construction comprising a generally circularshaped rear panel, a pair of arcuately shaped, band-like members are connected to the rear panel member, and top and bottom front panel members connected to the front edges of the band-like members. The members which make up the panels are interconnected in such a manner as to provide secure overlocking closure of the pouch for compact storage of a shopping bag without requiring the use of a fastener on the pouch.

7 Claims, 7 Drawing Sheets

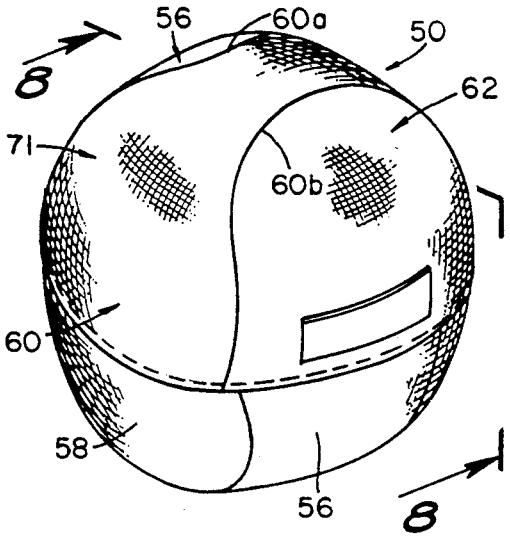
FIG. 6
FIG. 7
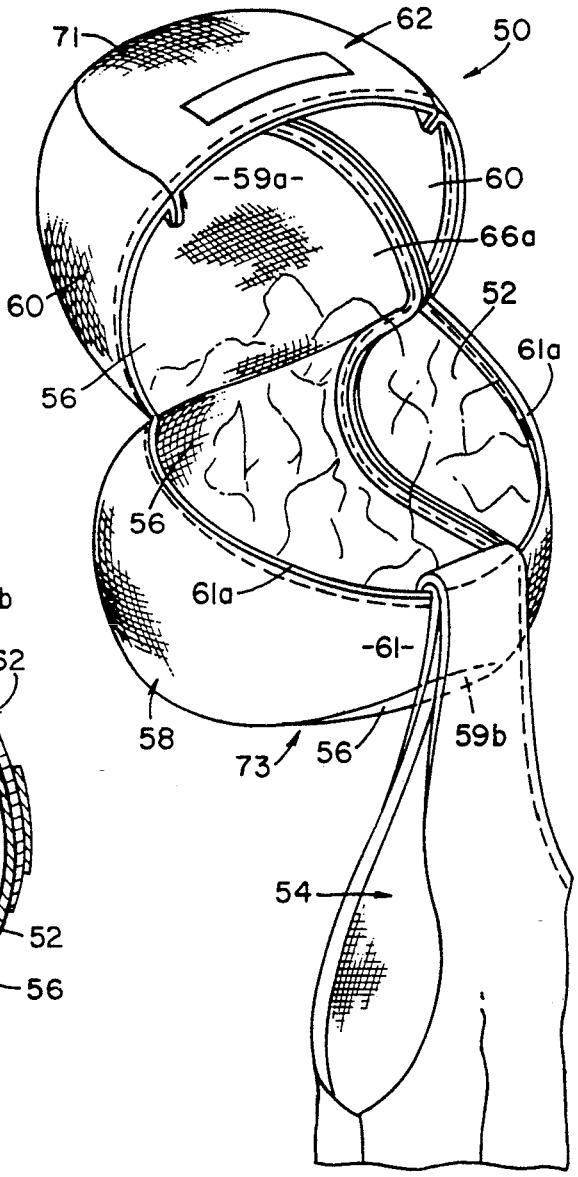
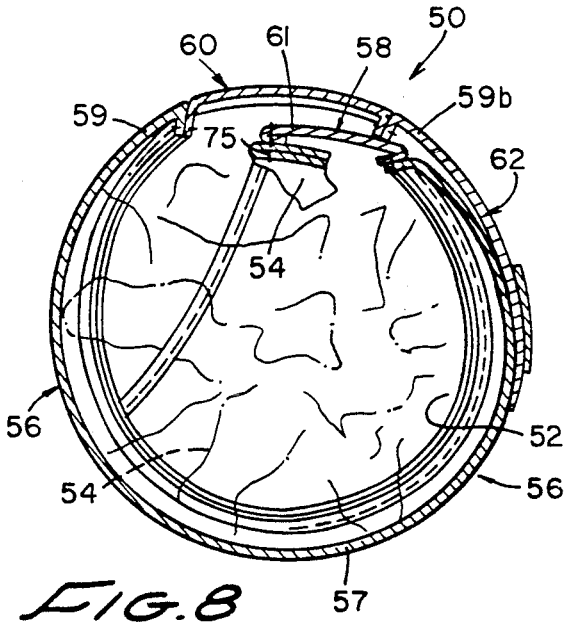
FIG. 8
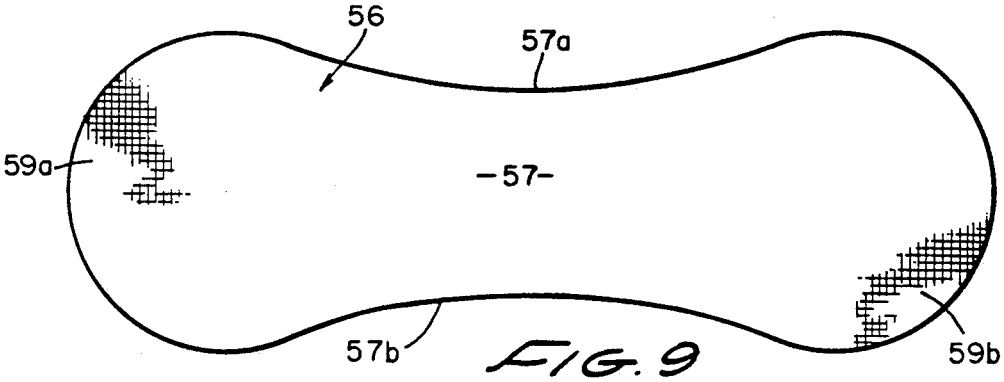
FIG. 9

SHOPPING BAG AND POUCH THEREFOR

This is a continuation-in-part application of co-pending U.S. application Ser. No. 07/845,231 which was filed on Mar. 3, 1992, now abandoned.

BACKGROUND OF THE INVENTION

1. Field of the Invention

The present invention relates generally to shopping bags and carrying pouches therefor. More particularly, the invention concerns an easy-to-use, self-closing, self-contained and highly-compact pouch for storage of reusable and disposable shopping bags.

2. Discussion of the Invention

Various types of shopping bags with companion pouches have been suggested in the past. Such prior art devices are typically fabricated from netting material with the pouch attached to the body of the bag itself, either at the base or at the mouth of the shopping bag. The method of insertion of the shopping bag into the pouch for transport and storage typically requires rolling or folding of the shopping bag in a very specific way so that it will fit into the pouch. If the bag is not properly rolled or folded, the pouch very often cannot be closed. After proper insertion of the bag into the pouch, the prior art pouches are generally closed with a button or zippered fastener thereby requiring a separate and somewhat cumbersome step in accomplishing secure closure of the pouch. Because of the aforementioned drawbacks, the prior art shopping bag and pouch combinations are so difficult to use that they are frequently discarded in frustration after one or two uses.

SUMMARY OF THE INVENTION

A principal object of the present invention is to overcome the drawbacks of the prior art pouches and companion shopping bag by providing a shopping bag which is easily storable in and retrievable from a pouch to which the shopping bag is conveniently attached. More particularly, the pouch is so constructed and arranged that it permits the insertion of the shopping bag and the secure closure of the pouch in one simple step.

In the preferred form of the invention, the pouch and its companion shopping bag are so compact that they can easily be carried in a pants pocket or in a handbag. The pouch is of unique construction comprising a generally circular-shaped rear panel, a pair of arcuately shaped, band-like members are connected to the rear panel member, and top and bottom front panel members connected to the front edges of the band-like members. The members which make up the panels are interconnected in such a manner as to provide secure overlocking closure of the pouch for compact storage of a shopping bag without requiring the use of a fastener on the pouch.

Unlike most prior art shopping bags with attached pouches, the device of the present invention does not require a number of operational steps to achieve secure storage of the shopping bag inside the pouch. The band-like members cooperate to form the periphery of the pouch and are connected to rear panel. These members, along with the bottom front panel, form the lower storage compartment of the apparatus. The top front panel uniquely overlaps the bottom front panel to securely close the pouch. When the pouch is open and empty, the top band along with the top front panel is turned inside out so as to provide easy, open access to the storage compartment. When closed the top band and the top front panel overlaps the bottom band and the bottom front panel respectively thereby securely closing the pouch.

As will become apparent from the discussion which follows, the pouch and shopping bag of the present invention is vastly superior to the prior art pouches in a number of ways. For example, the pouch of the present invention provides greater ease of use offering one step bag insertion and secure closure of the shopping bag in the pouch without the us of auxiliary fasteners.

In summary, it is an object of the invention to provide a pouch for simple and compact storage of a shopping bag when not in use, which is extremely compact so as to permit the device to be carried in a pants pocket or in a handbag.

It is another object of the invention to provide a device of the aforementioned character which provides the user with a readily apparent means of closure which can be quickly and easily executed in one simple step.

It is yet another object of the invention to provide a shopping bag with a pouch connected to the handle of the bag in such a way that the pouch provides both additional padding to the handle of the bag and also provides a mechanism for locking the two handles of the bag closed.

It is still another object of the invention to provide a pouch of the class described which can take various geometric forms.

It is still another object of the invention to provide a stand-alone pouch for storage of a plurality of disposable plastic shopping bags so that they can be easily returned to the store for reuse or recycling.

It is still another object of the invention to provide a reusable shopping bag which is very easy to load and unload, stands on its own when full, is very strong and yet is constructed of compressible material such that it takes up a very small space when folded or inserted into a pouch.

It is yet another object of the invention to provide a reusable shopping bag which is light weight and highly durable in use.

BRIEF DESCRIPTION OF THE DRAWINGS

FIG. 6 is a generally perspective view of an alternate form of ball-shaped shopping bag and pouch of the present invention in a closed configuration.

FIG. 7 is a generally perspective view similar to FIG. 6 but showing the pouch in an open configuration.

FIG. 8 is a cross-sectional view taken along lines 8—8 of FIG. 6.

FIG. 9 is a plan view of one of the component parts of the carrying pouch.

DESCRIPTION OF THE INVENTION

Figure 1:
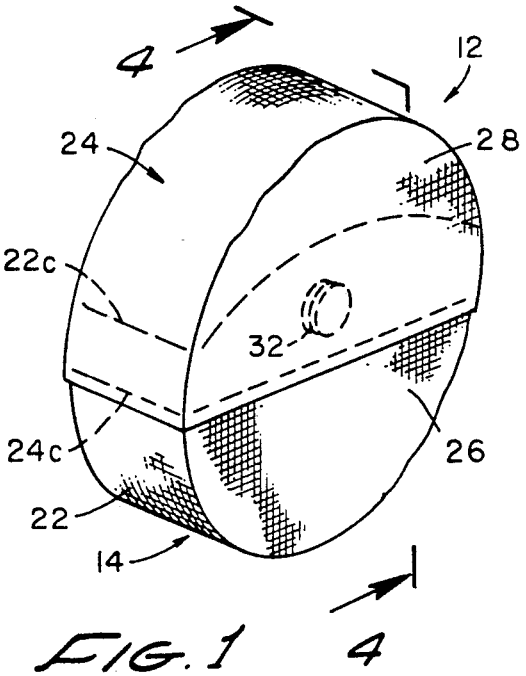
FIG. 1 is a generally perspective view of one form of the shopping bag and pouch of the present invention in a closed configuration.
Figure 2:
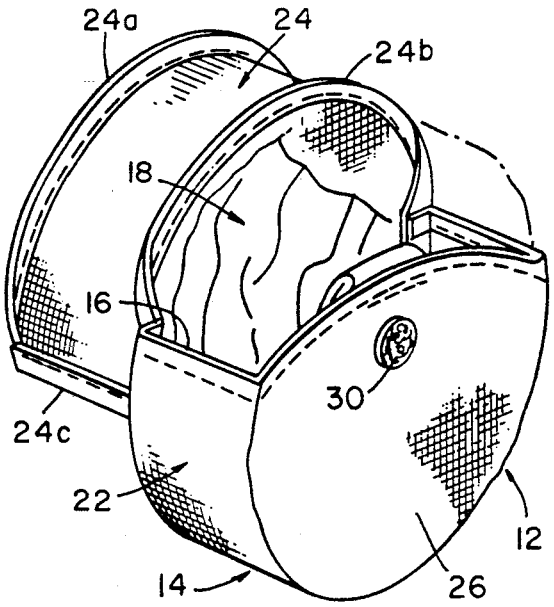
FIG. 2 is a generally perspective view similar to FIG. 1 but showing the pouch in an open configuration.
Figure 3:
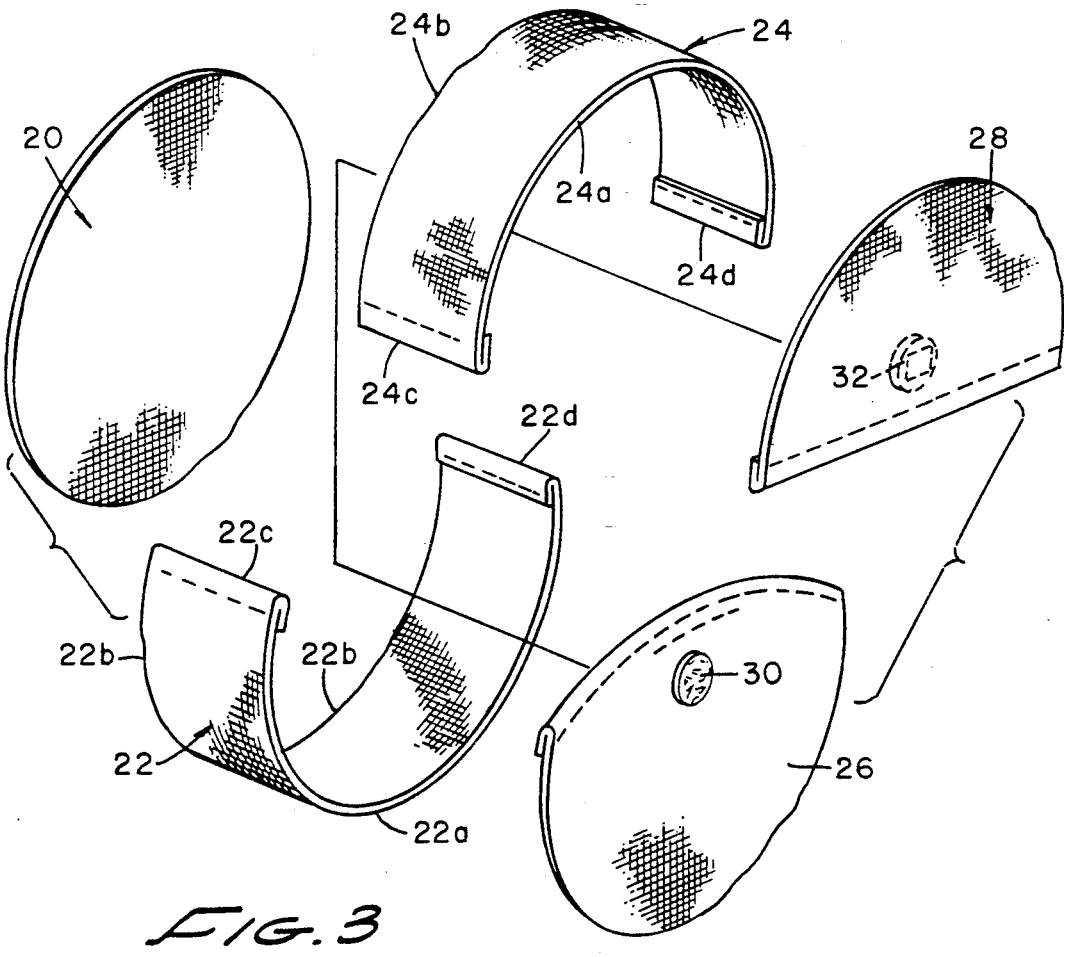
FIG. 3 is a generally perspective exploded view illustrating the configuration of the various components of the pouch portion of the device of the invention.

Referring to the drawings and particularly to FIGS. 1, 2 and 3, the shopping bag and carrying pouch therefor is generally designated by the numeral 12. In the form of the invention shown in the drawings, the device comprises an outer pouch portion 14 which includes an interior chamber 16 adapted to contain a shopping bag or like article 18 in a folded configuration. In FIG. 1, the apparatus of the invention is shown in a closed storage or transport configuration. In FIG. 2, the apparatus is shown in an open configuration for ready removal of the folded shopping bag 18 from the pouch chamber 16.

Referring particularly to FIG. 3, the various panel members which make up the pouch of the present invention are there illustrated. These members include a generally circularly shaped flexible back panel 20, a first generally cylindrically shaped, flexible band 22 and a second generally semi-cylindrically shaped flexible band 24. First band 22 is provided with generally parallel front and back edges 22*a* and 22*b* respectively and circumferentially-spaced ends 22*c* and 22*d*. Band 22 is interconnected with back panel 20 in any suitable manner as by adhesive bonding or by sewing edge 22*b* to the lower peripheral portion of back panel 20 in the manner best seen in FIG. 4 When so interconnected, front edge 22*a* of first band 22 is disposed in a first plane extending generally parallel to, but spaced from, the plane of back panel 20. Second band 24 is also provided with front and rear edges 24*a* and 24*b* respectively. Band 24 is also suitably affixed to back panel 20 by bonding or sewing edge 24*b* to the upper peripheral edge portion of back panel 20.

A generally semi-circular shaped front panel 26 is interconnected with the front edge 22*a* of band 22 as by sewing or by other suitable means. As can be seen by once again referring to FIG. 2, when front panel 26 is interconnected with band 22 and band 22 is in turn interconnected with back panel 20, these panel members cooperate to define chamber 16 within which the folded shopping bag is partially contained.

To complete the assembly of the pouch of the form of the invention shown in the drawings, a second generally circular shaped upper panel 28 is suitably affixed to the front edge 24*a* of band 24.

An extremely important aspect of the device of the present invention resides in the fact that second band 24 is movable from a first position shown in FIG. 1, wherein edges 24*a* reside in a second plane, to a second position shown in FIG. 2 where edge 24*a* resides in a third plane which is generally parallel to but substantially spaced apart from the plane of back panel 20.

With band 24 located in the second position shown in FIG. 2, it is apparent that chamber 16 is wide open to accept insertion of shopping bag 18 therein or for ready removal of shopping bag 18 from chamber or compartment 16.

Figure 4:
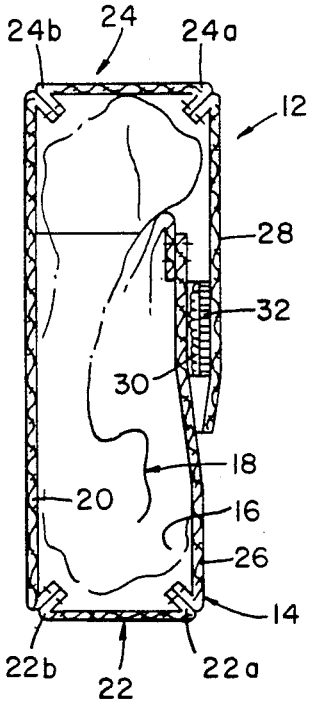
FIG. 4 is a cross-sectional view taken along lines 4—4 of FIG. 1.

Turning now to FIGS. 1 and 4, it is to be noted that when band 24 is in its first storage and transport position shown in FIG. 1, edge 24*a* of band 24 is disposed in a plane parallel with and closely adjacent to the first plane within which edge 22*a* of band 22 resides. It is also to be noted that when the device is in the closed configuration shown in FIG. 1, front panel 28 substantially overlaps lower front panel 26 so as to provide a positive interlocking closure of chamber 16 thereby securely encapsulating shopping bag 18 within the structure. In this closed position, ends 24*c* and 24*d* of band 24 substantially overlap ends 22*c* and 22*d* respectively of band 22 thereby further securing the pouch in the closed transport position shown in FIG. 1. This overlapping of the end portion of the bands results because, in the present form of the invention, the combined lengths of first and second bands 22 and 24 is somewhat greater than the circumference of back panel 20.

Figure 5:
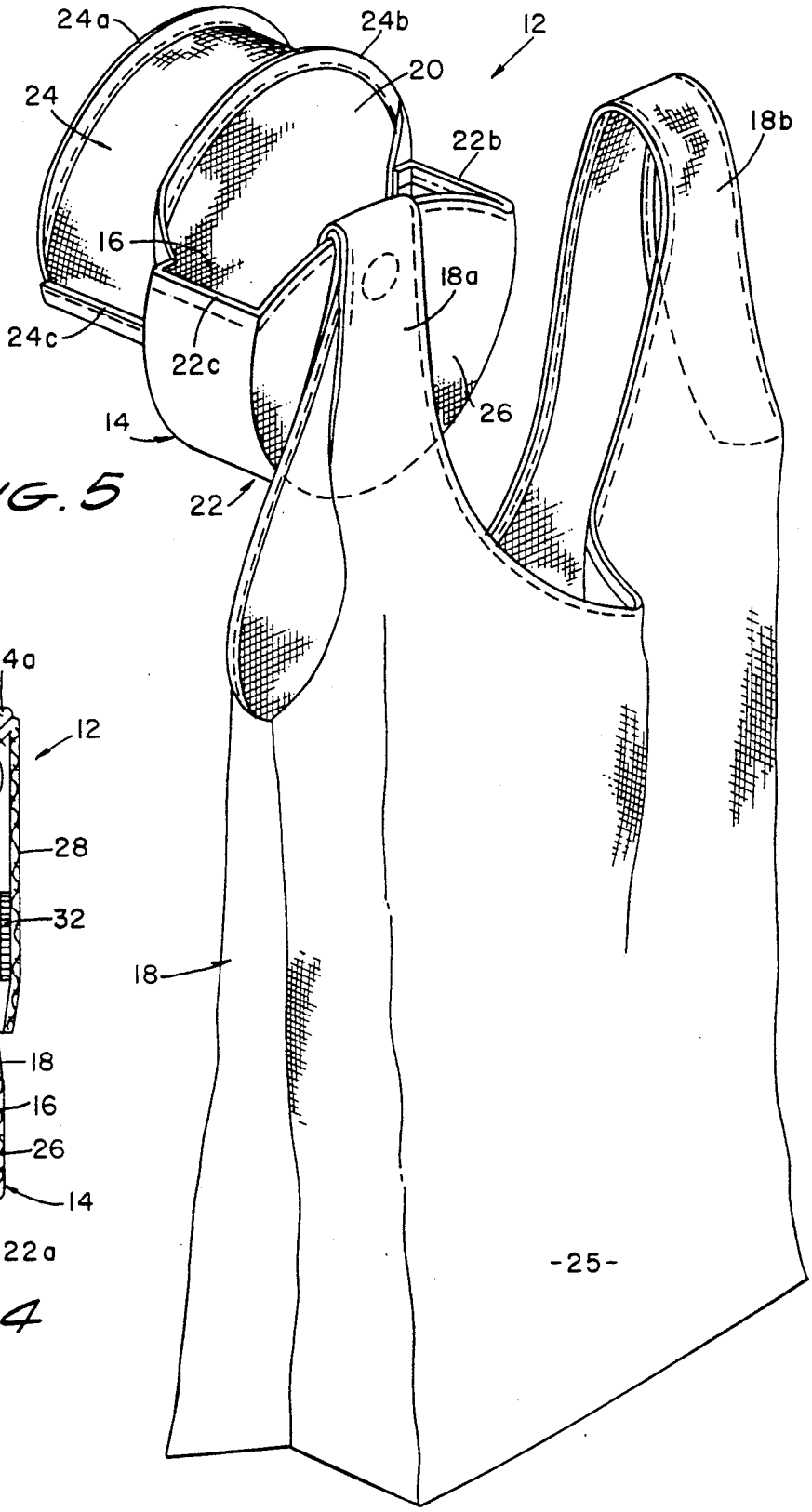
FIG. 5 is a generally perspective view similar to FIG. 2 but showing the shopping bag removed from the carrying pouch.

Referring to FIGS. 2 and 5, it is to be noted that bag 18 is provided with a storage-defining body portion 25 and a pair of spaced-apart carrying straps 18*a* and 18*b* so that the shopping bag will not become separated from the pouch. Carrying strap 18*a* of the shopping bag is connected as by sewing with the interior of front panel 26 in the manner illustrated in FIGS. 2 and 5. Accordingly, when the bag is inserted into chamber 16 from the operable configuration shown in FIG. 5 to the storage position shown in FIG. 2, carrying straps 18*a* and 18*b* will easily fold into the interior of chamber 16.

For certain applications, it is desirable to include a connector means for releasably interconnecting first and second panels 26 and 28 when the apparatus is in the closed storage and transport position shown in FIG. 1. In the embodiment of the invention shown in the drawings, this closure means is provided in the form of a first generally circular shaped segment of material 30 which is affixed to lower front panel 26. Segment 30 is provided with a multiplicity of hook-like protuberances. A second, generally circular shaped mating segment of material 32 is provided on the inner face of front panel 28. Segment 32 is provided with a multiplicity of loop-like elements which positively interconnect with hook-like elements provided on segment 30 thereby releasably locking together segments 30 and 32 when the segments are brought into juxta position and merged together by a slight finger pressure. It is to be understood that the closure means could also take the form of buttons, mechanical closure snaps or a variety of other types of connector elements well known to those skilled in the art.

While the apparatus of the invention can be made in a wide variety of sizes, it is preferable that the apparatus be constructed of thin, highly flexible cloth-like or plastic material so that when the device is configured in its storage and transport configuration shown in FIG. 1, it is somewhat soft and flexible and readily receivable within a pants pocket or lady's purse for convenient transport and later use during shopping.

It is also to be understood that for certain end applications, shopping bag 18 can be removed from the pouch and the pouch used to contain one or more separate carrying bags such as thin plastic bags of the character dispensed in food supermarkets and the like.

Turning now to FIGS. 6 through 13, another form of the shopping bag and carrying pouch therefor of the present invention is there illustrated. In this form of the invention, the device takes on the character of a toy as well as a novel utilitarian article. More particularly, as best seen in FIG. 6, the article in its folded configuration has the appearance of a ball. As shown in FIGS. 7 and 8, this embodiment comprises an outer pouch portion 50 having the general appearance of a baseball, which includes an interior chamber 52 adapted to contain a shopping bag or like article 54 in a folded configuration. In FIG. 6, the apparatus of the invention is shown in a closed storage or transport configuration. In FIG. 7, the apparatus is shown in an open configuration for ready removal of the folded shopping bag 54 from the pouch chamber 52.

Figures 10, 11, 12, 13:
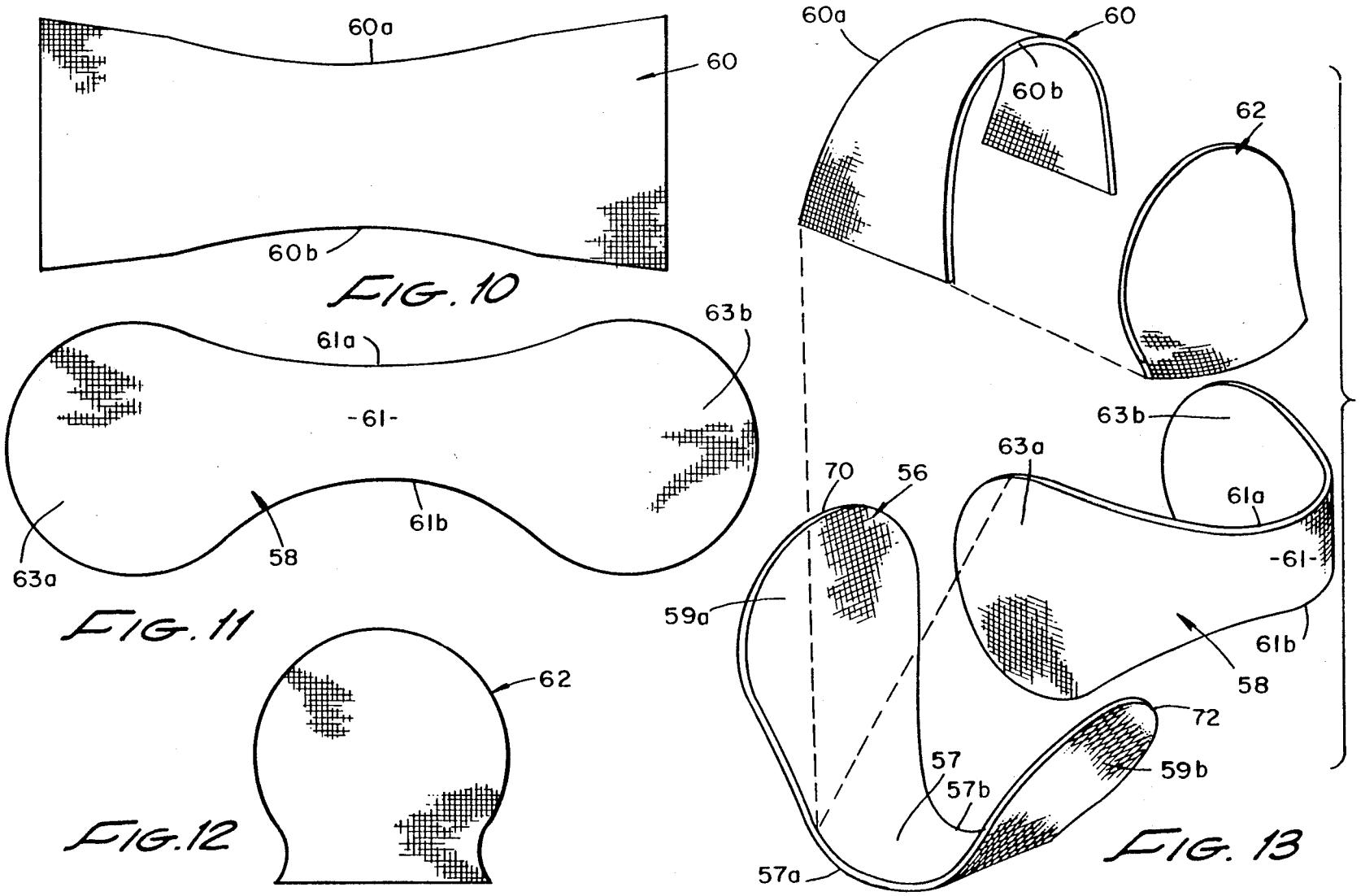
FIG. 10 is a plan view of another component of the carrying pouch.
FIG. 11 is a plan view of yet another component of the pouch.
FIG. 12 is a plan View of still another component of the pouch.
FIG. 13 is a generally perspective, exploded view of the carrying pouch of FIG. 6 showing the manner in which the component parts of the pouch are assembled.

Referring to FIGS. 9 through 13, the various panel members which make up the pouch of the present invention are there illustrated. These members include a first generally bar bell shaped flexible panel 56 (FIG. 9), a second generally bar bell shaped flexible panel 58 (FIG. 11), which is identical to panel 56, an elongated flexible band 60 having inwardly curved margins 60*a* and 60*b* and a generally semicircular shaped flexible panel 62 (FIG. 12). Panel 56 includes a central portion 57 having spaced apart first and second curved margins 57*a* and 57*b* respectively. Panel 56 also includes first and second semicircularly shaped end portions 59*a* and 59*b* each having a curved marginal portion. Panel 58, like panel 56, includes a central portion 61 having spaced apart first and second curved margins 61*a* and 61*b* respectively. Panel 58 also includes first and second semicircularly shaped end portions 63*a* and 63*b* each having a curved marginal portion.

Turning to FIG. 13, it is to be observed that panel 62 is interconnected with margin 60*b* of band 60 in any suitable manner such as by adhesive bonding or by sewing together margin 60*b* and the peripheral portion of panel 62 to form the upper closure portion 71 of the pouch. Similarly, margin 70 of end portion 59*a* of panel 56 is connected to margin 60*a* of band 60 and margin 72 of end portion 59*b* of panel 56 is connected to margin 61*b* of central portion 61 of panel 58 to form the lower container portion 73 of the pouch and the back closure surface 66*a* of the closure portion.

An extremely important feature of the apparatus of this latest form of the invention resides in the fact that the main panels 56 and 58 are uniquely shaped so that when the respective edges of the panels are placed in a contiguous relationship, the three dimensional generally spherically shaped object is formed. This creates a utilitarian pouch for receipt of the shopping or lunch bag while at the same time creating a novelty, toy-like object resembling a baseball thereby having appeal to adults and children alike.

Another important aspect of the apparatus is the hood-like cover portion which is made up of band 60, end portion 59*a* of panel 56 and front panel 62. This hood-cover portion functions to positively close the pouch without changing the generally spherical configuration thereof. Stated another way, in the absence of band 60 and front panel 62, portion 59*a* of panel 56 would fold over so that its edge would be contiguous with edge portion 61*a* (FIG. 7) to form a generally spherical shape. The addition of band 60 and front panel 62 to form the hood-like upper closure portion identified by the numeral 71 in FIG. 7 permits positive closure of the pouch to securely encapsulate bag 54 in the manner indicated in FIGS. 6 and 8.

As best seen in FIGS. 7 and 8, the flexible bag 54 is connected to the central portion of panel 58 by connector means shown here as a sewn interconnection 75 (FIG. 8). It is to be understood that bag 54 can be constructed of cloth or other suitable material and can be affixed to the pouch by any suitable means other than by sewing such as by snaps or the like.

Figure 14:
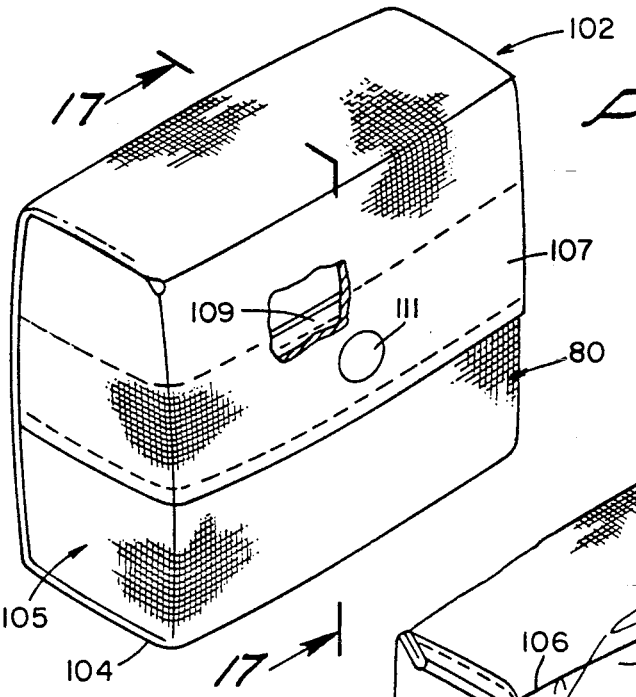
FIG. 14 is a generally perspective view of another alternate form of shopping bag and pouch of the present invention in a closed configuration.
Figure 16:
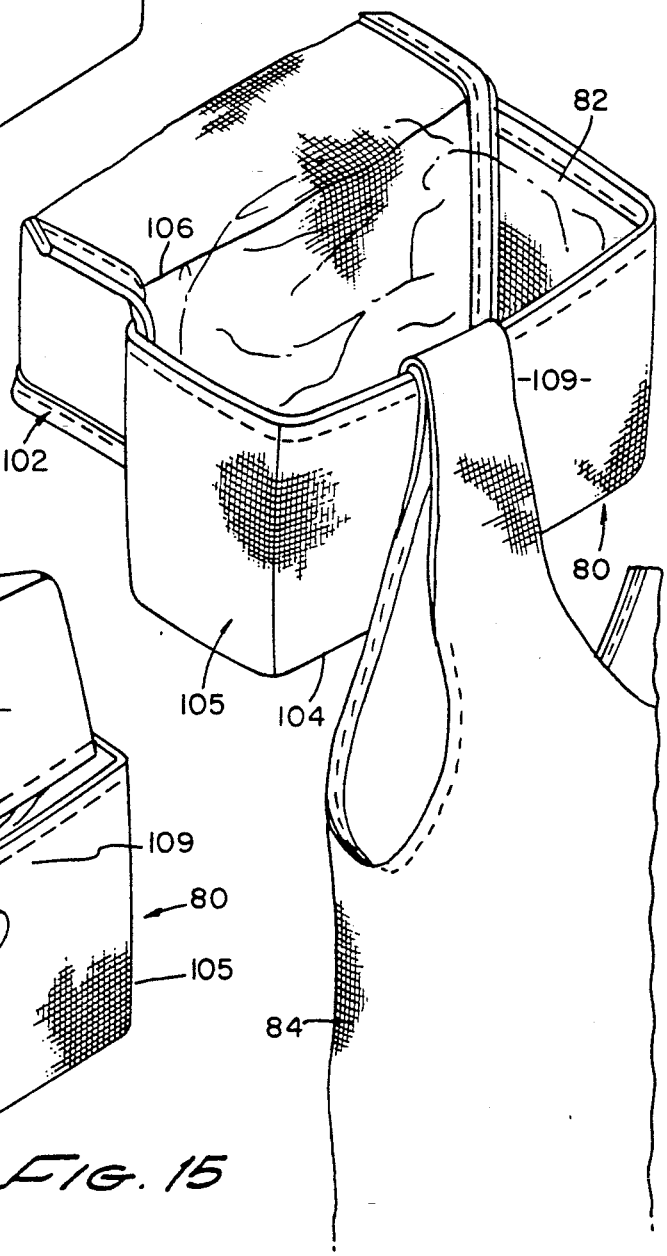
FIG. 16 is a generally perspective view of the bag and carrying pouch in an open configuration with the bag portion of the device removed from the pouch.
Figure 15:
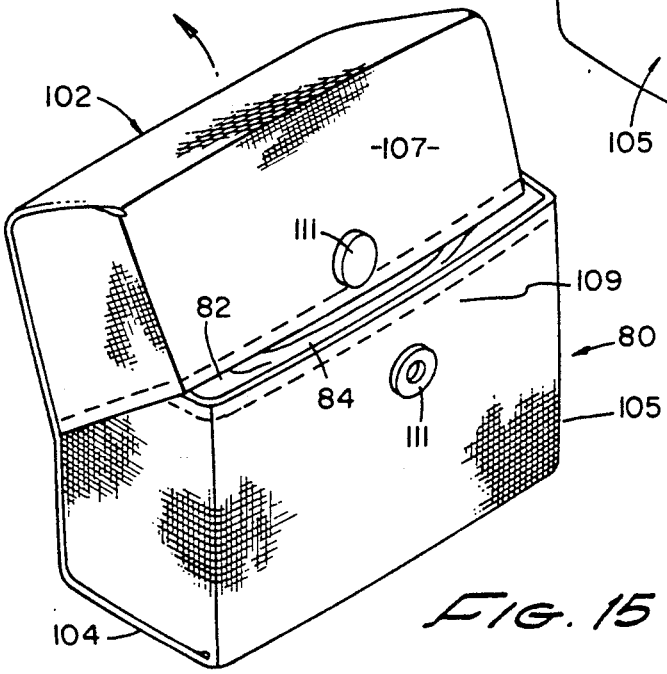
FIG. 15 is a generally perspective view similar to FIG. 14 but showing the pouch in a partially open configuration.

Turning now to FIGS. 14 through 21, yet another embodiment of the invention is there shown. This embodiment is unique in that the pouch portion of the apparatus is formed entirely from a single, uniquely configured panel having the shape shown in FIG. 18. When the single panel is folded in the manner shown in FIG. 14, the pouch portion 80 of the apparatus is formed. This portion includes an interior chamber 82 (FIGS. 16 and 17) adapted to contain a shopping bag or like article 84 in a folded configuration. In FIG. 14, the apparatus of this latest form of the invention is shown as it appears in a closed storage or transport configuration. In FIG. 16, the apparatus is shown in an open configuration for easy withdrawal of the folded shopping bag 84 from the pouch chamber 82. In FIG. 15, the pouch is shown in a partially open configuration.

Figures 17, 18, 19:
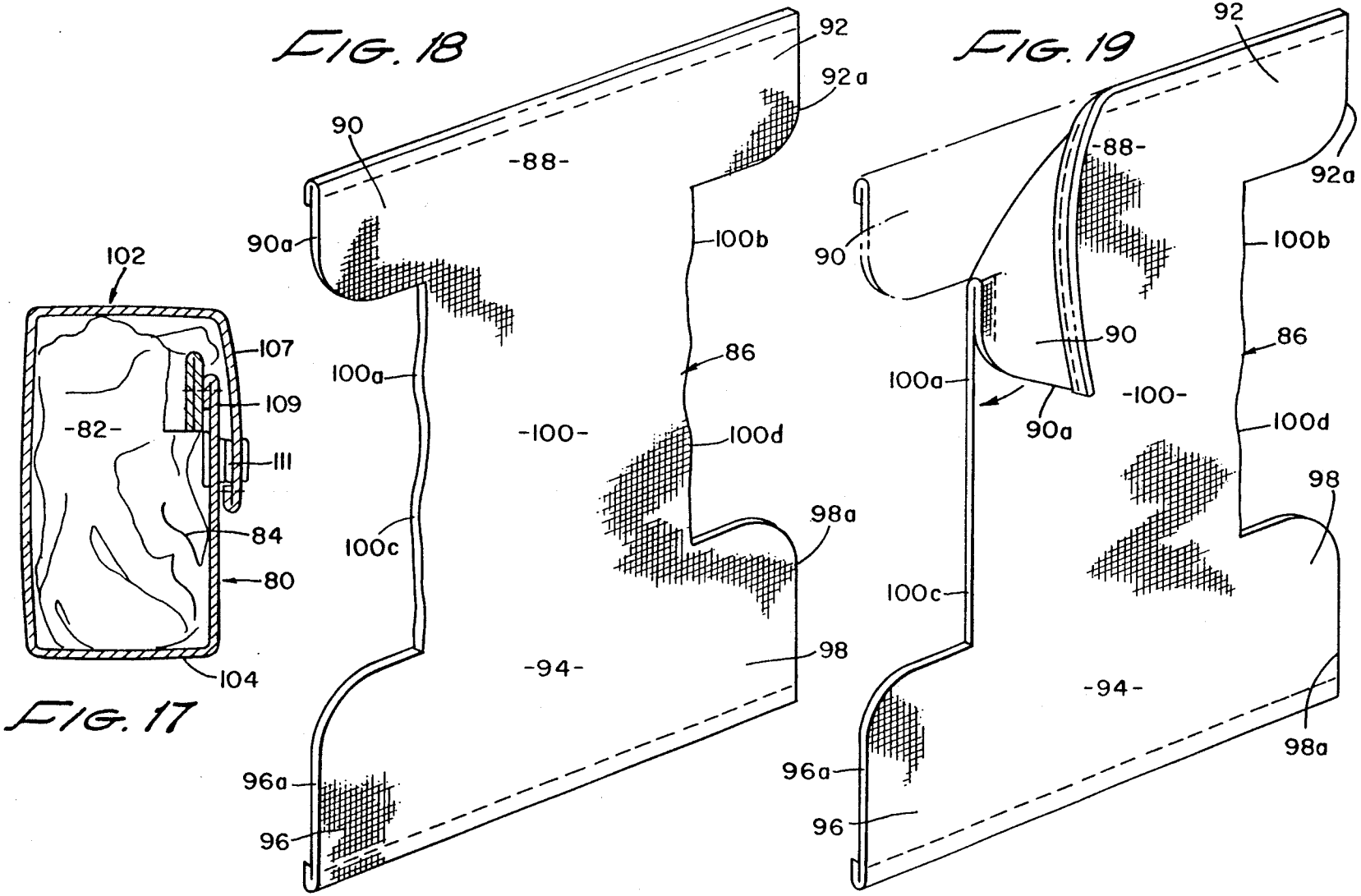
FIG. 17 is a cross-sectional view taken along lines 17—17 of FIG. 14.
FIG. 18 is a generally perspective view of the single panel from which the carrying pouch of this latest form of the invention is constructed.
FIG. 19 is a generally perspective view of the panel of FIG. 18 showing the first step of the pouch forming operation.

Referring particularly to FIG. 18, the single panel member 86 which makes up the pouch of the invention is there illustrated in an unfolded, starting configuration. This member is generally "I" shaped, having an upper portion 88 including outwardly extending ears 90 and 92 and a somewhat larger lower portion 94 having outwardly extending ears 96 and 98. Disposed intermediate portions 88 and 94 is a central portion 100.

Figures 20, 21:
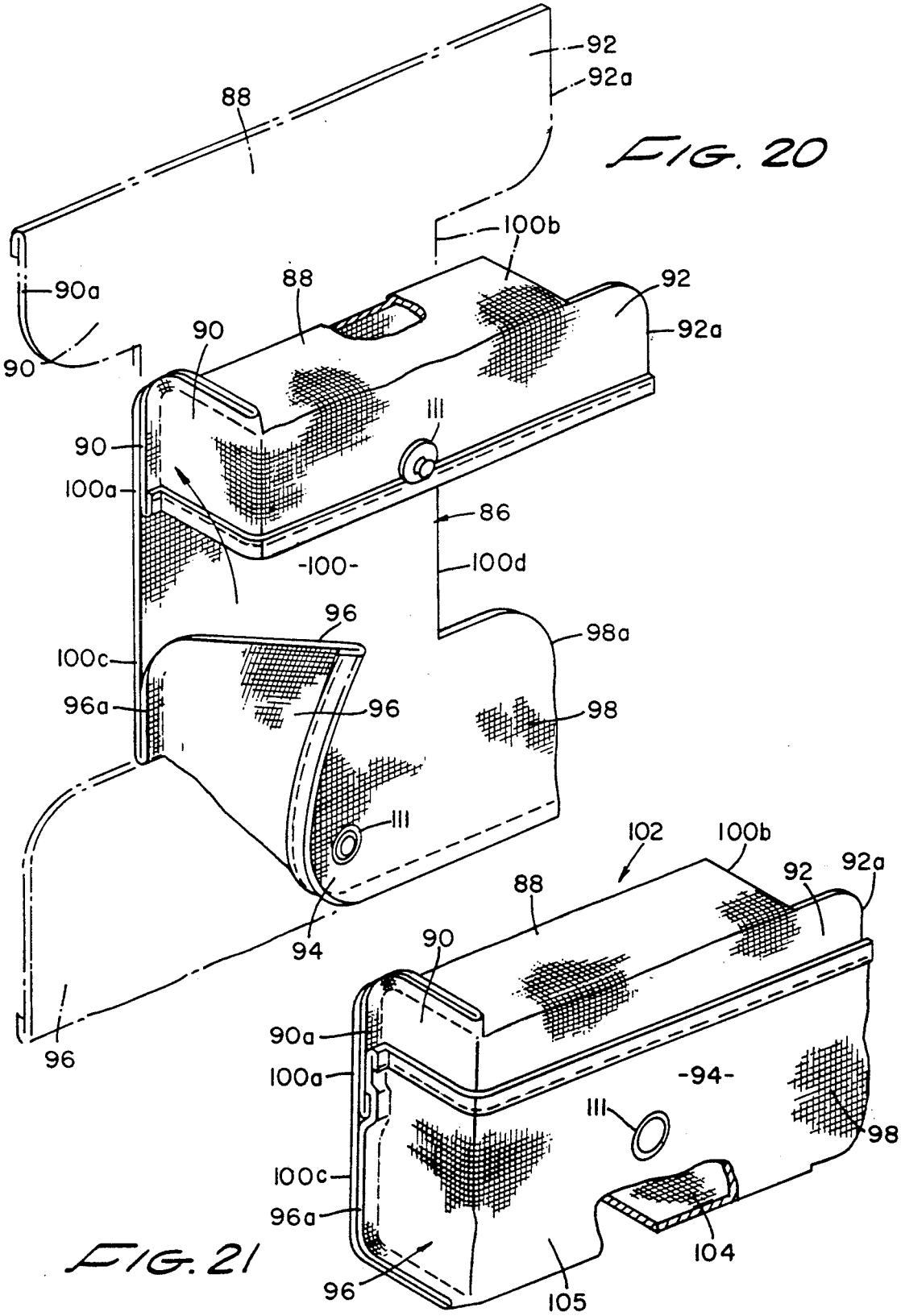
FIG. 20 is a generally perspective view showing a further step in the forming operation.
FIG. 21 is a generally perspective view of the carrying pouch partly broken away to show internal construction.

As illustrated in FIGS. 19, 20 and 21, panel 86 is strategically folded to make the pouch in the following manner: First top portion 88 is folded forwardly and edge 90*a* of ear 90 is attached to edge 100*a* of central portion 100 (FIG. 20). Next edge 92*a* of ear 92 is connected to edge 100*b* of portion 100 (see also FIGS. 18 and 19). This forms the cover or closure portion of the pouch, generally designated in FIG. 14 by the numeral 102. Following formation of the cover portion, the bag enclosure or body portion 105, including a bottom wall 104, is formed by affixing edges 96*b* and 98*b* to edges 100*c* and 100*d* in the manner shown in FIGS. 20 and 21.

With the construction thus described, cover portion will pivot about a fold line 106 (FIG. 15) so it can freely move between the fully open position shown in FIG. 16 to the fully closed position shown in FIGS. 14 and 17 wherein the forward flap 107 of the cover portion overlaps portion 109 of the bag enclosure portion. Means for interconnecting the cover portion with the hollow body or bag enclosure portion is provided and is here shown as a snap 111 of the conventional design can be used to hold the cover portion in a closed position.

As was the case with the earlier described embodiments of the invention, the embodiments shown in FIGS. 6 through 21 can be made in a wide variety of sizes. Similarly, various materials can be used to construct the apparatus, but it is preferable that it be constructed of thin, highly flexible cloth-like or plastic material so that when the device when in its storage and transport configuration is somewhat soft and flexible and readily receivable within a pants pocket or lady's purse for convenient transport and later use during shopping.

It is also to be understood that for certain end applications, the shopping bag portions of the embodiments can be removed from the pouch and the pouch used to contain one or more separate carrying bags such as thin plastic bags of the character dispensed in food supermarkets and the like.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A generally ball shaped enclosure for carrying articles, comprising first and second elongated, flexible panels each having curved end margins and spaced apart, inwardly curved central margins, one of said end margins of said first panel being interconnected with one of said curved central portions of said second panel the other end margin of said first panel being spaced and unconnected with said second panel; and said curved end portions of said second panel being interconnected with said curved central portion of said first panel to define a generally spherical-shaped hollow body.

2. A generally ball shaped enclosure as defined in claim 1 further including a flexible band having first and second spaced-apart, curved margins, said curved end margins of said first elongated flexible panel being interconnected with said first curved margin of said flexible band.

3. A generally ball shaped enclosure as defined in claim 2 further including a flexible end panel interconnected with said second curved margin of said flexible band.

4. A generally ball shaped enclosure as defined in claim 3 further including means for connecting the article to be carried to the enclosure.

5. A ball shaped enclosure for carrying a foldable bag comprising:

(a) a first flexible panel having a first end portion with a curved margin, a second end portion with a curved margin and an intermediate portion having spaced apart first and second inwardly curved margins;

(b) an elongated band having first and second spaced apart curved margins, said first curved margin being connected to said curved margin of said first end portion of said first flexible panel;

(c) an end panel having a curved margin interconnected with said second curved margin of said elongated band;

(d) a second flexible panel having a first end portion with a curved margin interconnected with said first curved margin of said intermediate portion of said first flexible panel; said second flexible panel also having a second end portion with a curved margin interconnected with said second curved margin of said intermediate portion of said first flexible panel; said second flexible panel further including an intermediate portion having spaced apart first, inwardly curved margins, said curved margin of said second end portion of said first flexible panel being interconnected with said second curved margin.

6. An enclosure as defined in claim 5 in which said first and second panels, said elongated band and said end panel are made from cloth, said marginal portions being interconnected by sewing.

7. An enclosure as defined in claim 5 further including means for attaching the flexible bag to said intermediate portion of said second flexible panel.

* * * * *